US009217548B2

(12) United States Patent
Shen

(10) Patent No.: US 9,217,548 B2
(45) Date of Patent: Dec. 22, 2015

(54) PORTABLE CAMPING LAMP

(71) Applicant: Ningbo Taller Electrical Appliance Co., LTD, Yuyao (CN)

(72) Inventor: Jianli Shen, Yuyao (CN)

(73) Assignee: Ningbo Taller Electrical Appliance Co., LTD (CN)

( * ) Notice: Subject to any disclaimer, the term of this patent is extended or adjusted under 35 U.S.C. 154(b) by 128 days.

(21) Appl. No.: 14/188,644

(22) Filed: Feb. 24, 2014

(65) Prior Publication Data

US 2015/0062883 A1 Mar. 5, 2015

(30) Foreign Application Priority Data

Aug. 28, 2013 (CN) ..... 2013 1 0382523

(51) Int. Cl.

| | |
|---|---|
| ***F21L 4/02*** | (2006.01) |
| ***F21L 4/08*** | (2006.01) |
| ***F21L 4/00*** | (2006.01) |
| *F21V 21/08* | (2006.01) |
| *F21V 21/40* | (2006.01) |
| *F21V 23/04* | (2006.01) |
| *F21Y 101/02* | (2006.01) |

(52) U.S. Cl.

CPC . *F21L 4/085* (2013.01); *F21L 4/00* (2013.01); *F21L 4/027* (2013.01); *F21V 21/08* (2013.01); *F21V 21/406* (2013.01); *F21V 23/0414* (2013.01); *F21Y 2101/02* (2013.01)

(58) Field of Classification Search

CPC ..... F21L 4/02; F21L 4/085; F21L 4/027; F21L 4/00; F21V 21/08; F21V 21/406; F21V 23/0414; F21Y 2101/02

See application file for complete search history.

(56) References Cited

U.S. PATENT DOCUMENTS

| | | | | |
|---|---|---|---|---|
| 4,819,141 | A * | 4/1989 | Maglica | F21L 4/005 362/187 |
| 2005/0052874 | A1* | 3/2005 | Shuniak | F21S 2/005 362/396 |
| 2011/0012518 | A1* | 1/2011 | Tarter | F21L 2/00 315/160 |

* cited by examiner

*Primary Examiner* — Mary Ellen Bowman

(74) *Attorney, Agent, or Firm* — Lawrence S. Cohen

(57) ABSTRACT

A battery powered portable illumination device especially suitable for camping use is disclosed having three modes of use. The first mode is with left and right light units positioned back to back shining in opposite directions defining a closed position. The second mode uses a hinge to allow the light units to be rotated about the hinge until the left and right light units are pointed in the same direction defining an open position. A hook is provided for suspending the lamp on a support when it is in this open position. The third mode is an auxiliary illumination assembly or flashlight that is stored in and removable from the interior of the lamp and can be used independently of the left and right light units. The light units typically are LEDs.

13 Claims, 7 Drawing Sheets

PORTABLE CAMPING LAMP

RELATED APPLICATION

This application is based upon and claims the benefit of priority under 35 U.S.C. §119 of Chinese Patent Application No. 201310382523.2 filed on Aug. 28, 2013 in the Peoples republic of China the entire contents of which are incorporated herein by reference.

FIELD OF THE INVENTION

This invention relates to an illumination device, and especially to a portable camping lamp suitable for outdoor lighting.

BACKGROUND OF THE INVENTION

Nowadays, illumination light devices suitable for outdoor usage always have a single fixed way of being used. When a user hangs a camping lamp on a high place, the camping lamp can only illuminate somewhere around the high place, but can't illuminate the place beneath the hanging position because of its structure. Further, in order to fulfill people's usage requirements, people doing outdoor activities usually bring various kinds of illumination light devices. In this way, people will have to bring a lot of things, the burden on the user will become heavier, and it will be inconvenient to bring them.

SUMMARY OF THE INVENTION

An object of the present invention is to provide a portable camping lamp having multiple illuminating modes. When the two illumination assemblies (as described below) are clamped together in a closed configuration, the illumination is to the side. When the two illumination assemblies are opened around a hinge, the illumination is downward. An auxiliary illumination assembly is provided inside which can be detached for independent lighting. The lamp is convenient to carry.

The portable camping lamp of the present invention comprises a base assembly, an illumination assembly mounted on the base assembly, an upper cover assembly mounted on the illumination assembly, and a handle provided on the upper cover assembly. The base assembly consists of a left base unit and a right base unit; the left base unit includes a lamp switch for turning on the illumination assembly; the right base unit includes a chargeable source unit for supplying the illumination assembly and a charging connector connected to the chargeable source unit; the lamp switch is electrically connected to the chargeable source unit. The illumination assembly consists of a left illumination unit and a right illumination unit; the left illumination unit and the right illumination unit are, respectively, attached to the left base unit and the right base unit; and the left illumination unit and the right illumination unit are hinged together at the bottom. An accommodating slot is provided on the right illumination unit. An auxiliary illumination assembly is arranged inside the accommodating slot. The auxiliary illumination assembly is retained inside the accommodating slot by means of a positioning mechanism provided on the upper cover assembly. A hook rotatable matched with the right illumination unit is provided on a lower part of the right illumination unit for hanging the illumination assembly on a support. The hook may rotate into a receiving slot provided on a lower part of the right illumination unit when the hook is not used.

In accordance with an embodiment of the invention, the right illumination unit includes a right casing; a curved reflector panel fixed outside the right casing by a screw; a right LED light unit attached to the inner side of the reflector panel and connected to the lamp switch; and a transparent cover clamped on the right casing, the right base unit and the upper cover assembly outside the reflector panel. The accommodating slot is provided on the right casing. A protruded portion protrudes, because of the arrangement of the accommodating slot, on a sidewall of the right casing opposite the left illumination unit. The receiving slot is provided on a lower portion of the protruded portion. A locking hole is provided on an upper end of the protruded portion. A positioning hole passes through one side of an upper portion of the right casing to the accommodating slot.

In accordance with an aspect of the invention, the left illumination unit, similar to the right illumination unit, includes a left casing; a curved reflector panel fixed on an outer wall of the left casing by a screw; a right LED light unit connected to the lamp switch and fixed at an inner side of the reflector panel; and a transparent cover clamped on the left casing, the left base unit and the upper cover assembly outside the reflector panel.

In accordance with another aspect of the invention, the upper cover assembly consists of an upper left cover unit and an upper right cover unit, the upper left cover unit and the upper right cover unit are mounted on upper portions of the left illumination unit and the right illumination unit, respectively. The upper left cover unit is provided with a locking mechanism for locking the left illumination unit and the right illumination unit together. The locking mechanism is locked on the locking hole. Another locking mechanism is mounted on the right casing for clamping the auxiliary illumination assembly inside the accommodating slot.

In accordance with yet another aspect of the invention, a charging mechanism which is connected to the chargeable source unit is provided in the accommodating slot. The chargeable source unit can charge the auxiliary illumination assembly through the charging mechanism.

In accordance with another aspect of the invention, the auxiliary illumination assembly includes a main casing, a rechargeable battery and an auxiliary LED light unit mounted in the main casing. The auxiliary LED light unit is electrically connected to the rechargeable battery. The main casing is also provided with an auxiliary switch for turning the auxiliary LED light on and off. A conductive wire connected with the charging source unit is provided on the bottom of the main casing; the rechargeable battery is electrically connected to the conductive wire; and, the chargeable source unit charges the rechargeable battery through the conductive wire.

In accordance with yet another aspect of the invention, a clamping hole matching the positioning hole is formed on the side wall of the main casing. One end of a positioning piece passes through the positioning hole and clamps on the clamping hole.

In accordance with an embodiment of the invention, the left illumination unit has a left inner wall; a left base outer wall; and a left LED light unit with the illumination of the LEDs directed away from the left inner wall. The right illumination has a right inner wall; a right base outer wall; and a right LED light unit with the illumination of the LEDs directed away from the right inner wall. A hinge rotatably couples the left illumination unit to the right illumination unit and has an axis in the left and right inner walls and the left and right base outer walls. The hinge holds the left illumination unit and right illumination unit in a closed configuration when the left and right inner walls abut each other; and, holds the left illumination unit and right illumination unit in an open configuration when the left and right base outer walls abut each other.

In yet another embodiment of the invention, the hook is attached to the camping lamp adjacent the axis of the hinge and the open hook end is directed away from the left base and right base.

In yet another embodiment of the invention, the left base unit and the right base unit, respectively, include a left base and a right base. Both of the outer walls of the left base and the right base are provided with supporting blocks and grooves opposite each other. When the left illumination unit and the right illumination unit spread, the supporting blocks on the outer walls of the left base and the right base are correspondingly embedded into the grooves of the right base and the left base.

The portable camping lamp of the present invention is suitable for outdoor usage, has multiple illuminating modes, fulfills people's various usage requirements for different environments, and is provided with the auxiliary illumination assembly which can be detached for independent lighting. In this way the user can have lighting in narrow spaces.

Figure 1:
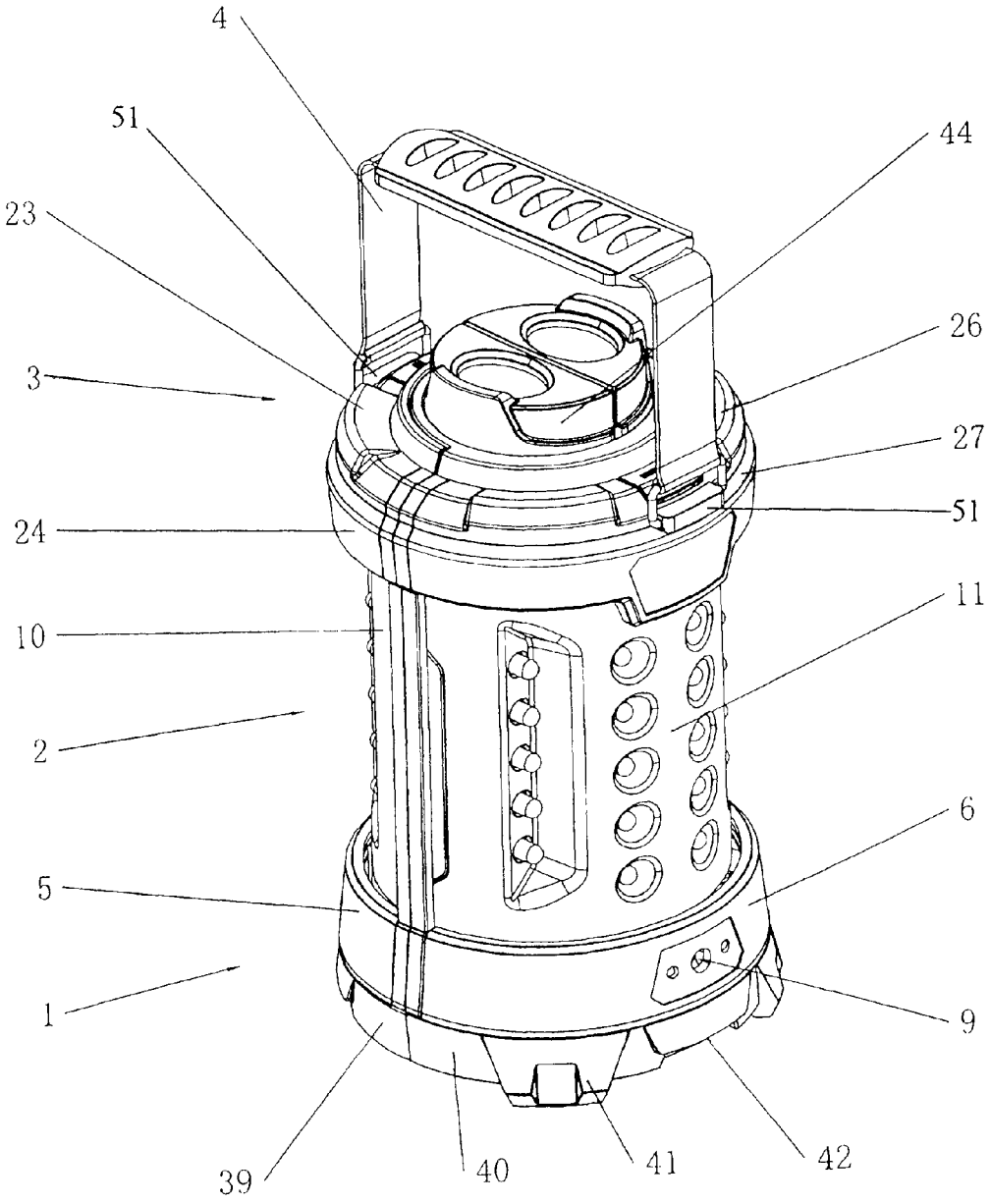
FIG. 1 is a perspective of the portable camping lamp of the present invention when the transparent cover is not mounted thereon.

In these figures, the following numbers are used:

1 base assembly
2 illumination assembly
3 upper cover assembly
4 handle
5 left base unit
6 right base unit
7 lamp switch
8 chargeable source unit
9 charging connector
10 left illumination unit
11 right illumination unit
12 accommodating slot
13 hook
14 receiving slot
15 right casing
16 reflector panel
17 right LED light unit
18 transparent cover
19 protruded portion
20 locking hole
21 positioning hole
22 left casing
23 top part of the upper left cover
24 bottom part of the upper left cover
25 pressing piece
26 top part of the upper right cover
27 bottom part of the upper right cover
28 positioning piece
29 outer cover
30 button
31 chassis
32 charging conductor pin
33 buffer spring
34 main casing
35 auxiliary LED light unit
36 rechargeable battery
37 conductive wire
38 clamping hole
39 left base
40 right base
41 supporting block
42 groove
43 auxiliary switch
44 auxiliary illumination assembly
45 hinge
46 hinge axis of rotation
47 left inner wall
48 right inner wall
49 left base outer wall
50 right base outer wall
51 buckle
52 direction of illumination of the left illumination unit
53 direction of illumination of the right illumination unit

DETAILED DESCRIPTION

In the following, the portable camping lamp of the present invention is further explained in connection with the figures.

Figure 2:
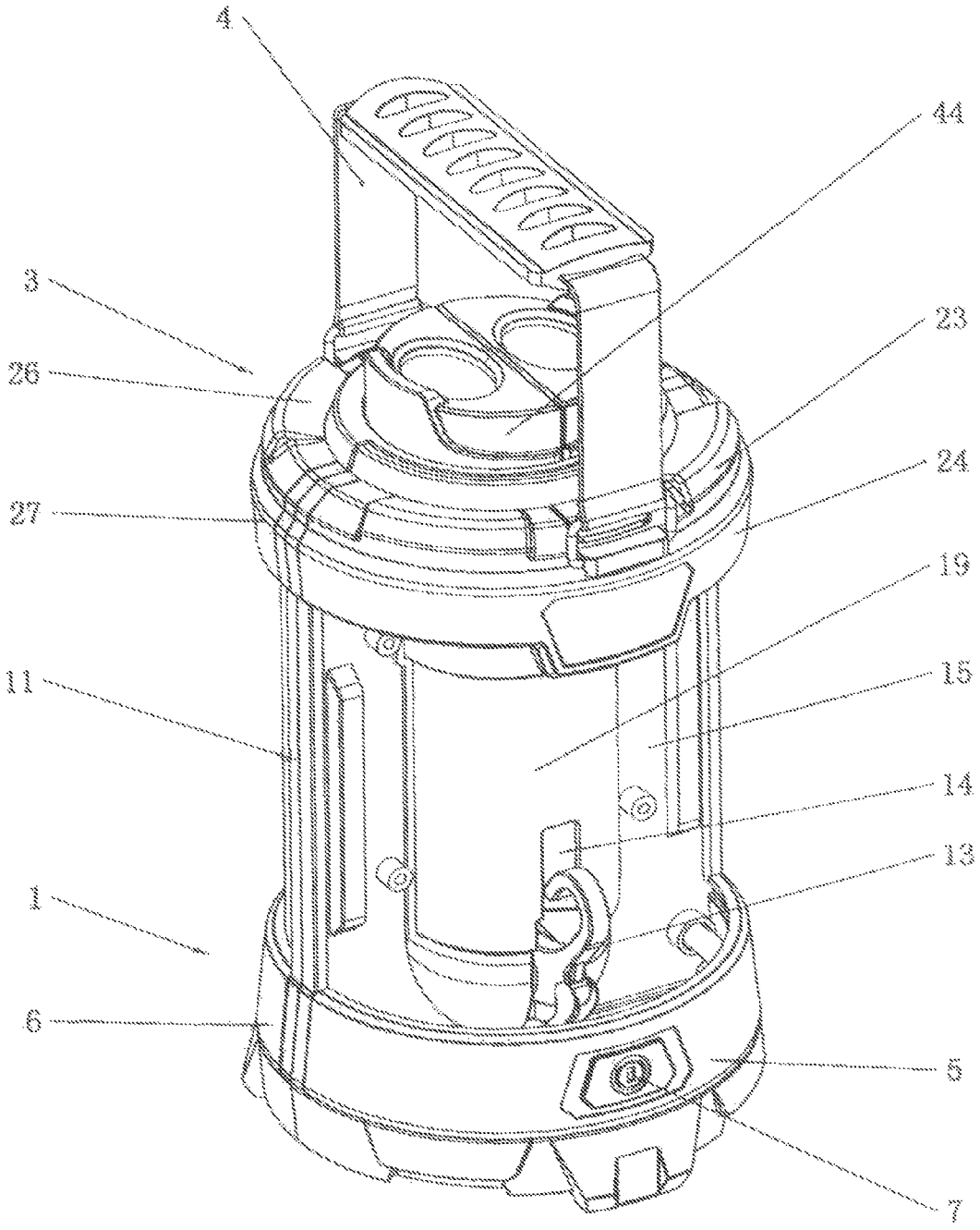
FIG. 2 is an internal perspective structure view of the portable camping lamp of the present invention rotated about 180 degrees relative to FIG. 1 with portions removed to allow an interior view.
Figure 3:
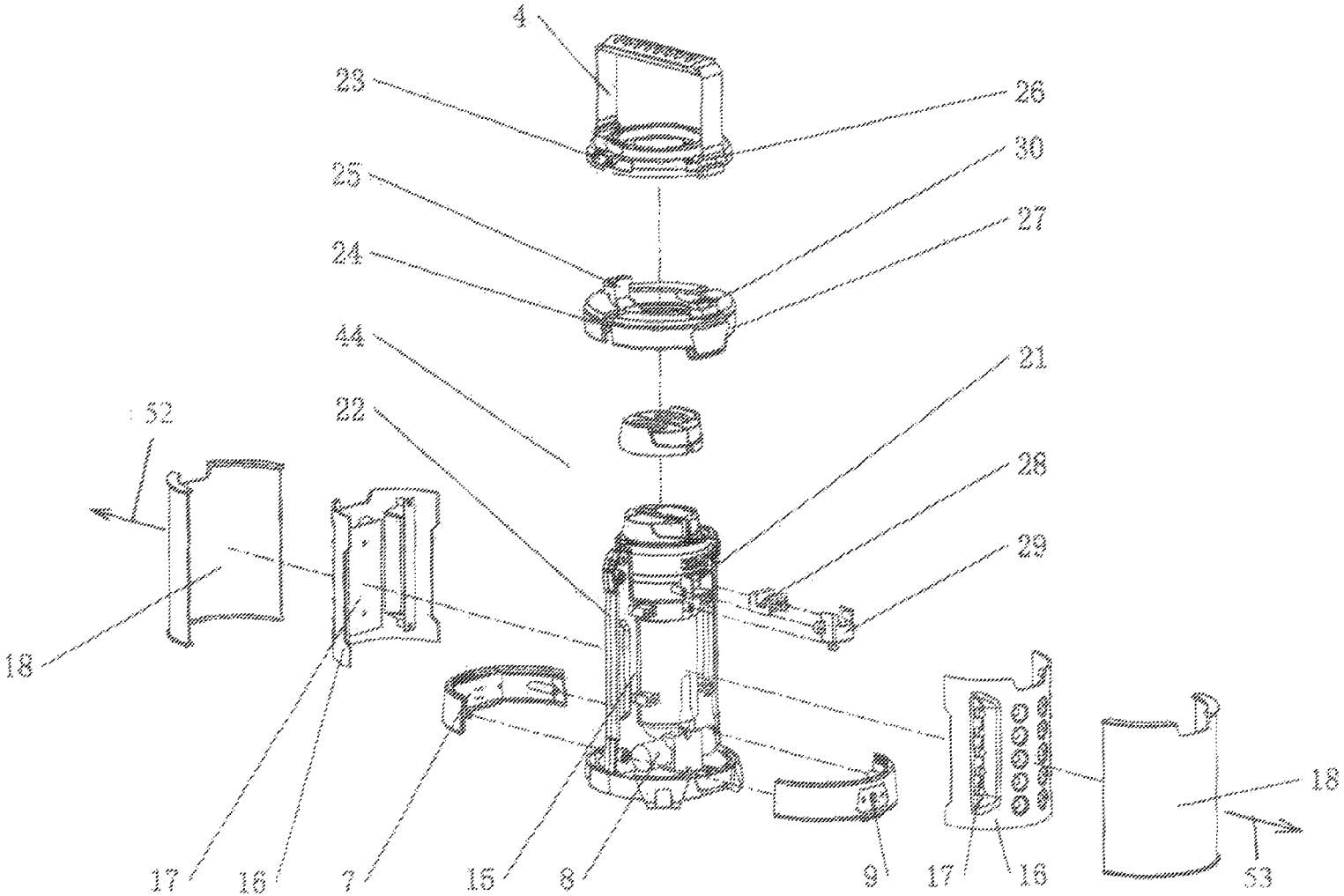
FIG. 3 is an exploded view of the portable camping lamp of the present invention.

As shown in FIGS. 1-3, the portable camping lamp of the present invention comprises a base assembly 1, an illumination assembly 2 mounted on the base assembly 1, an upper cover assembly 3 mounted on the illumination assembly 2 and a handle 4 provided on the upper cover assembly 3. The handle 4 is buckled on both sides of the upper cover assembly 3 by means of buckles 51 on both side of the handle 4 connected to the upper cover assembly 3. When the handle 4 is to be detached, it is only necessary to detach the buckles 51 from the upper cover assembly 3.

The base assembly 1 consists of a left base 39 and left base unit 5 and a right base 40 and right base unit 6. The left base 39 and base unit 5 include a lamp switch 7 for turning on and off the illumination assembly 2. The right base unit 40 and right base unit 6 include a chargeable power source unit 8 for supplying the illumination assembly 2 and a charging connector 9 connected to the chargeable source unit 8. The lamp switch 7 is electrically connected to the chargeable source unit 8.

Figure 7:
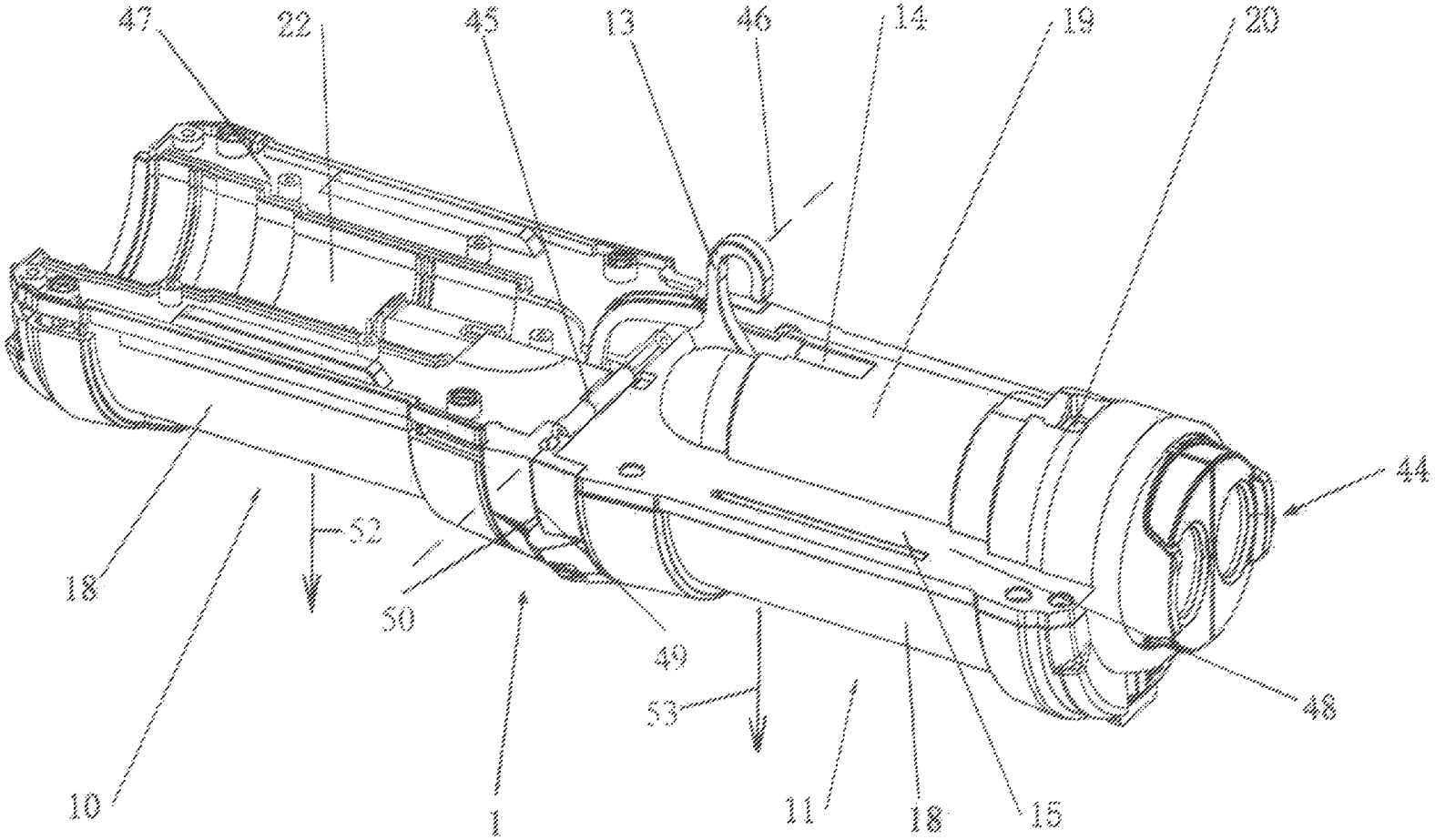
FIG. 7 is a perspective structure view of the portable camping lamp of the present invention in the open position with each illumination unit.

The illumination assembly 2 consists of a left illumination unit 10 and a right illumination unit 11. The left illumination unit 10 and the right illumination unit 11 are mounted on the left base 39 and left base unit 5 and the right base 40 and right base unit 6, respectively. The left illumination unit 10 and the right illumination unit 11 are hinged together by a hinge 45 (FIG. 7) which is attached to and extends across the bottom of the left base unit 5 and the bottom of the right base unit 6 allowing hinged rotation from a closed first position shown in FIGS. 1-3 to an open second position shown in FIG. 7. During one mode of use, in the first position, the left illumination unit 10 and the right illumination unit 11 are clamped together to the closed position as shown in FIGS. 1-3. In this position the illumination from the illumination units extend in opposite aligned directions 52, 53. When one place is to be illuminated, another mode is used. In that mode the left and right illumination units are respectively rotated to a second position, the open position, as shown in FIG. 7. The left illumination unit 10 and the right illumination unit 11 are opened by being rotated about the hinge 45 as shown in FIG. 7. In this way, the left illumination unit 10 and the right illumination unit 11 have the same illuminating direction, in parallel, so that centralized illumination of one spot is realized.

The right illumination unit 11 is provided with an accommodating slot 12 (FIG. 4) for holding an auxiliary illumination assembly 44. The auxiliary illumination assembly 44 can be separately detached for use. The auxiliary illumination assembly 44 is held inside the accommodating slot 12 by means of a positioning mechanism provided on the upper cover assembly 3. Specifically, the auxiliary illumination assembly 44 is retained in the accommodating slot 12 by the positioning mechanism. When the auxiliary illumination assembly 44 is to be detached for use, it is only necessary to open the positioning mechanism to take it out.

A hook 13 (FIG. 7) is rotatably matched with a receiving slot 14 provided on a lower part of the right illumination unit 11. When the hook 13 is not used, it is rotated into the slot. When the left illumination unit 10 and the right illumination unit 11 are opened as show in FIG. 7, the hook 13 is used to hang the portable camping lamp on a support, and centralized illumination can be directed on the place to be illuminated.

As shown in FIG. 3, the right illumination unit 11 includes a right casing 15, a curved reflector panel 16 attached outside the right casing 15 by a screw, and a right LED light unit 17 connected to the lamp switch 7 attached to the inner side of the reflector panel 16. A transparent cover 18 is clamped on the right casing 15, the right base 40 and base unit 6, and the upper cover assembly 3 outside the reflector panel 16. The accommodating slot 12 is arranged on the right casing 15. A protruded portion 19 protrudes on a sidewall of the right casing 15 opposite the left illumination unit 10 for providing the accommodating slot 12. The receiving slot 14 is arranged on a lower portion of the protruded portion 19. A locking hole 20 is provided on an upper end of the protruded portion 19. A positioning hole 21 passes through one side of an upper portion of the right casing 15 to the accommodating slot 12.

The left illumination unit 10 includes a left casing 22 matched with the right illumination unit 11, a curved reflector panel 16 attached to an outer wall of the left casing 22 by a screw, and a left LED light unit 17 connected to the lamp switch 7 attached to the inner side of the reflector panel 16. A transparent cover 18 is clamped on the left casing 2, the left base 39 and left base unit 5, and the upper cover assembly 3 outside the reflector panel 16.

The upper cover assembly 3 consists of an upper left cover unit and an upper right cover unit, the upper left cover unit and the upper right cover units are mounted on upper portions of the left illumination unit 10 and the right illumination unit 11, respectively. The upper left cover unit is provided with a locking mechanism for locking the left illumination unit 10 and the right illumination unit 11 together. The locking mechanism clamps in the locking hole 20. The upper left cover unit includes a top upper left cover 23 and a lower upper left cover 24. The locking mechanism is mounted in the lower upper left cover 24. The locking mechanism includes a pressing piece 25 and a spring (not shown in the Figures) mounted on the pressing piece 25. The ends of the spring abut against the pressing piece 25 and the left casing 22. The pressing piece 25 is substantially "L"-shaped, one side of which is provided with a barb. The barb is clamped in the locking hole 20. The top upper left cover 23 is provided with a passage for the pressing piece 25 to pass through, an upper end of the pressing piece 25 passes through the passage and extends outside the passage. When the user wants to rotate the left illumination unit 10 and the right illumination unit 11 to the open second position shown in FIG. 7, it is only necessary to press the pressing piece 25 making the pressing piece 25 detach from the locking hole 20. Then the left illumination unit 10 and the right illumination unit 11 can be opened about the hinge 45.

A positioning mechanism is arranged on the right casing 15, for clamping the auxiliary illumination assembly 44 inside the accommodating slot 12. The upper right cover unit includes a top upper right cover 26 and a lower upper right cover 27. The positioning mechanism is mounted in the lower upper right cover 27. The positioning mechanism includes a positioning piece 28 provided in the positioning hole 21 and movable inside the positioning hole 21. An outer cover 29 is screwed on the right casing 15 and positioned at the positioning hole 21. A button 30 is located in an upper portion of the outer cover 29 and slides in the bottom part of the right cover 27. A restoring spring (not shown in the Figures) is provided between the positioning piece 28 and the outer cover 29 as well as between the button 30 and the outer cover 29. A slope on the button 30 and a slope on the positioning piece 28 work with each other. During operation, it is only necessary for the user to press the button 30 forcing the slope on the button 30 to push on the slope on the positioning piece 28 moving the positioning piece towards the outer cover 29 releasing the clamping between the positioning piece 28 and the auxiliary illumination assembly 44. In this way, the user can fetch out the auxiliary illumination assembly 44 from the accommodating slot 12 to use it. After it has been used, it is only necessary for the user to insert the auxiliary illumination assembly 44 into the accommodating slot 12, and the positioning mechanism will automatically position it.

Figure 4:
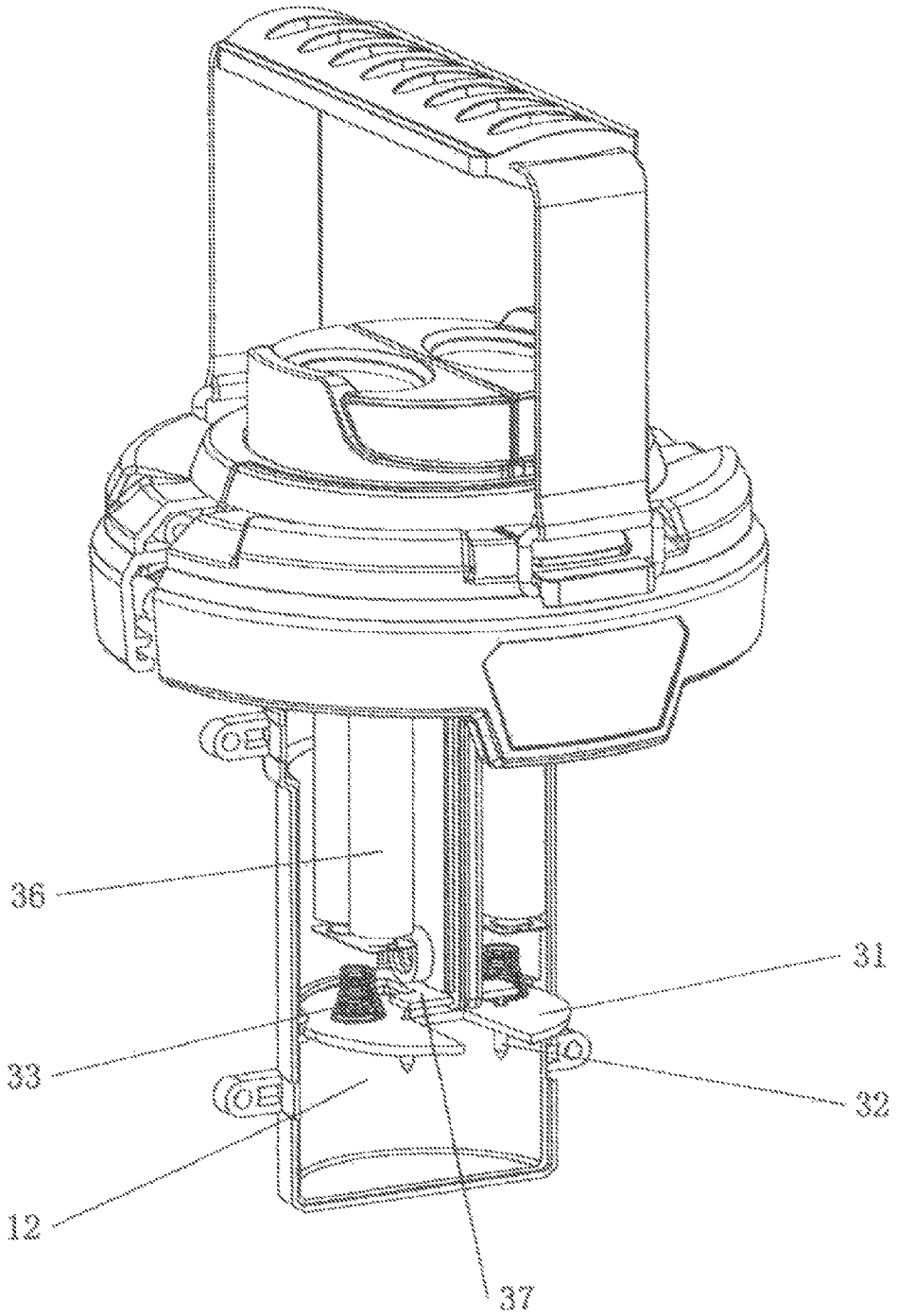
FIG. 4 is a perspective structure view of the charging mechanism of the auxiliary illumination assembly when it is in the portable camping lamp.
Figure 5:
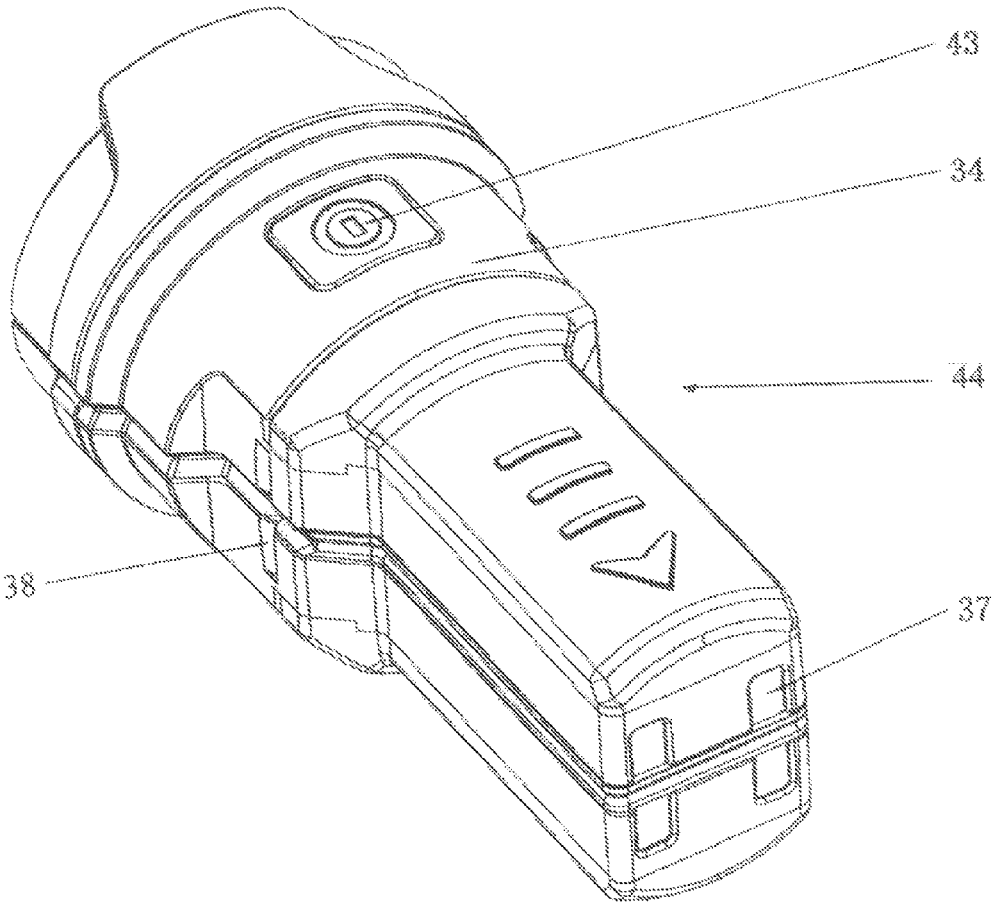
FIG. 5 is a perspective structure view of two auxiliary illumination assemblies of the portable camping lamp of the present invention.

As shown in FIGS. 3-5, a charging mechanism connected to the chargeable source unit 8 is provided in the accommodating slot 12. The chargeable source unit 8 can charge the auxiliary illumination assembly 44 through the charging mechanism. Specifically, the auxiliary illumination assembly 44 is an illumination light device for separate use that has a rechargeable battery 36. The rechargeable battery 36 is charged by the chargeable source unit 8. In this way, when the user charges the chargeable source unit 8, the rechargeable battery 36 accommodated in the auxiliary illumination assembly 44 is also charged synchronously. The charging mechanism includes a chassis 31 clamped in the accommodating slot 12. The chassis 31 is provided with multiple charging conductor pins 32. The charging conductor pins 32 are electrically connected to the chargeable source unit 8. The chassis 31 is also provided with a buffer spring 33. When the user inserts the auxiliary illumination assembly 44 back into the accommodating slot 12, the bottom of the auxiliary illumination assembly 44 contacts the buffer spring 33 resisting the descent of the auxiliary illumination assembly 44 until it is locked in place thus protecting the auxiliary illumination assembly 44. When the auxiliary illumination assembly 44 is released by pushing on button 30, the buffer spring pushes it up slightly allowing it to be grasped at the top and lifted out of the camping lamp for separate use.

Figure 6:
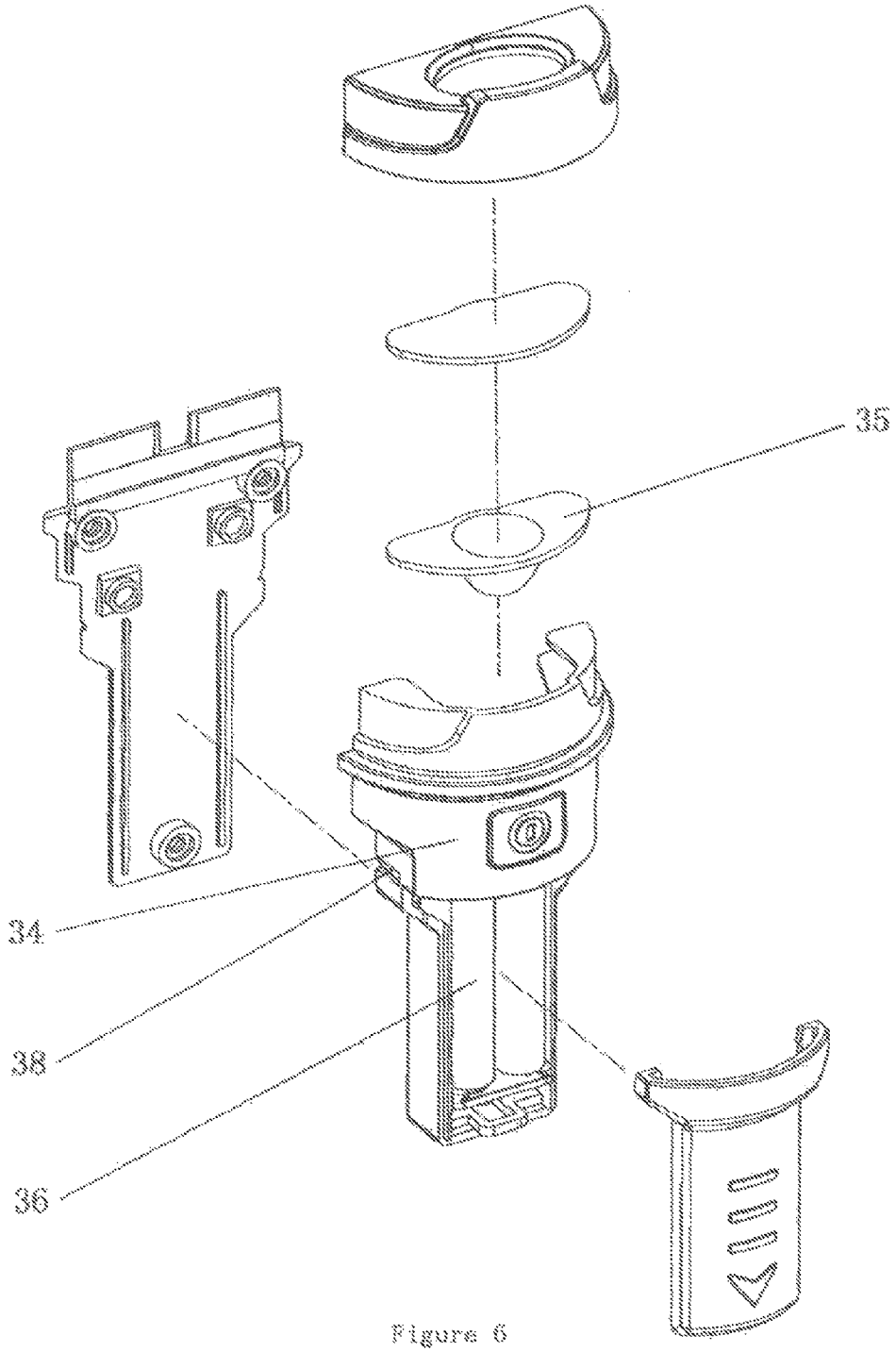
FIG. 6 is an exploded view of the auxiliary illumination assembly.

As shown in FIGS. 4-6, the auxiliary illumination assembly 44 includes a main casing 34, a rechargeable battery 36 and the auxiliary LED light unit 35 mounted in the main casing 34. The auxiliary LED light unit 35 is electrically connected to the rechargeable battery 36. The main casing 34 is also provided with an auxiliary switch 43 for turning the LED light unit 35 on and off. A conductive wire 37 connected with the charging mechanism is provided on the bottom of the main casing 34. The rechargeable battery 36 is electrically connected to the conductive wire 37. The charging mechanism charges the rechargeable battery 36 through the conductive wire 37. In this embodiment, two auxiliary illumination assemblies 44 are arranged in the accommodating slot 12. These two auxiliary illumination assemblies 44 are fixed back to back. When the user fetches out the auxiliary illumination assembly 44, these two auxiliary illumination assemblies 44 can be fetched out at the same time for usage.

When the auxiliary illumination assembly 44 is located in the accommodating slot 12, the upper terminal of the charging conductor pin 32 contacts the conductive wire 37. In this way, electrical connection between the rechargeable battery 36 and the chargeable source unit 8 is realized. When the auxiliary illumination assembly 44 is located in the accommodating slot 12 and the conductive wire 37 contacts the charging conductor pins 32, the chargeable source unit 8 will charge the rechargeable battery 36.

As shown in FIGS. 3-4, a clamping hole 38 corresponding to the positioning hole 21 is formed on side wall of the main casing 34 of the auxiliary illumination assembly 44. When the auxiliary illumination assembly is located in the accommodating slot 12, one end of the positioning mechanism passes through the positioning hole 21 and is matched with and clamps in the clamping hole 38.

As shown in FIG. 7, the left base unit 5 and the right base unit 6 include a left base 39 and a right base 40, respectively. Both of the outer walls of the left base 39 and the right base 40 are provided with supporting blocks 41 and grooves 42 opposite each other. When the left illumination unit 10 and the right illumination unit 11 are opened about the hinge 45 as shown in FIG. 7, the supporting blocks 41 on the outer walls of the left base 39 and the right base 40 are correspondingly embedded into the grooves 42 of the right base 40 and the left base 39, holding them rigidly with respect to each other in conjunction with the hinge 45.

In use in the open mode, the left illumination unit 10 is rotated about hinge 45 in relation to right illumination unit 11. In this open configuration, all of the LEDs of the left and right illumination units are pointed in one direction in parallel usually downward, when the camping light is hung from a support on hook 13. Specifically, left illumination unit 10 has an inner wall 47 and right illumination unit 11 has an inner wall 48. The inner walls are complementary to each other including the axis of the hinge 45 allowing the left and right illumination units to be rotated about hinge 45. The LEDs of the left illumination unit are directed away from the left inner wall as represented by the arrow 52. The LEDs of the right illumination unit are directed away from the right inner wall as represented by the arrow 53.

In the closed mode, the left and right illumination units are rotated until the left and right inner walls abut each other and the illumination units are clamped together as shown in FIGS. 1-3 in a closed configuration. In the closed configuration, the LEDs of the left illumination unit are directed away from the left inner wall as represented by the arrow 52 and the LEDs of the right illumination unit are directed way from the right inner wall as represented by the arrow 53. When the left and right illumination units are clamped together as shown in FIGS. 1-2, the LEDs of the left illumination unit are pointed away from the LEDs of the right illumination unit. Left illumination unit 10 has a left bottom outer wall 49 and right illumination unit 11 has a right bottom outer wall 50. The left bottom outer wall is substantially perpendicular to the left inner wall. The right bottom outer wall is substantially perpendicular to the right inner wall. The bottom outer walls are also complementary to each other including the axis of rotation 46 of the hinge 45 allowing the left and right illumination units to be rotated about hinge 45 until the left and right bottom outer walls abut each other to the second position defining an open position as shown in FIG. 7. The axis of rotation 46 is orthogonal to the direction of illumination as represented by the arrows 52, 53 of the left and right illumination assemblies. The LEDs of the left illumination unit are then pointed in the same direction as the LEDs of the right illumination unit. The hook 13 is attached to the camping lamp adjacent the axis of the hinge and the open hook end is directed away from the left and right bases 39, 40 such that gravity holds the left and right illumination units 10, 11 open when the camping lamp is suspended on a support using the hook. The hook is offset from the axis of the hinge sufficiently to balance the weight between the left and right illumination units with the right illumination unit having the added weight of the auxiliary illumination assembly 44 and the left illumination assembly having the added weight of the charging source unit 8. In order to stabilize the open position, the outer walls of the left base 39 and the right base 40 are provided with supporting blocks 41 and grooves 42 opposite each other.

The above descriptions are only some preferred embodiments, and it should be pointed out that, as for a person skilled in the art, modifications and alternatives can be made without departing from the discipline of the invention, and such modifications and alternative also fall within the scope of the invention.

The invention claimed is:

1. A portable illumination device having a closed position and an open position comprising:

a base assembly, an illumination assembly mounted on the base assembly, an upper cover assembly mounted on the illumination assembly, and a handle provided on the upper cover assembly, an auxiliary illumination assembly and a hook wherein:

the base assembly comprising a left base unit and a right base unit; the left base unit includes a lamp switch for turning the illumination assembly on and off; the right base unit includes a chargeable source unit for supplying the illumination assembly and a charging connector connected to the chargeable source unit; and, the lamp switch is electrically connected to the chargeable source unit;

the illumination assembly comprising a left illumination unit and a right illumination unit; the left illumination unit and the right illumination unit are respectively and correspondingly fixed and mounted on the left base unit and the right base unit; the left illumination unit and the right illumination unit are rotatably hinged together by a hinge attached to and extending across the left base unit and the right base unit allowing hinged rotation from a closed to an open position;

an accommodating slot on the right illumination unit; and the auxiliary illumination assembly being fitted inside the accommodating slot; the auxiliary illumination assembly being held inside the accommodating slot by means of a positioning mechanism provided on the upper cover assembly; and, the hook is attached on a lower part of the right illumination unit, whereby the hook may rotate into a receiving slot provided on a lower part of the right illumination unit in the closed position when the hook is not used and may rotate out of the receiving slot when the device is in the open position.

2. A portable illumination device according to claim 1, the right illumination unit further comprising a right casing, a curved reflector panel fixed outside the right casing, a right LED light unit connected to and with the lamp switch fixed at the inner side of the reflector panel; a transparent cover clamped to the right casing with the right base unit, and the upper cover assembly outside the reflector panel; and with the accommodating slot arranged on the right casing having a protruded portion forming a portion of the accommodating slot and being provided on a sidewall of the right casing opposite to the left illumination unit; the receiving slot is arranged on a lower portion of the protruded portion; a locking hole provided on an upper end of the protruded portion; a positioning hole passes through one side of an upper portion of the right casing to the accommodating slot.

3. A portable camping lamp according to claim 2, the left illumination unit comprising: a left casing matched with the right illumination unit; a curved reflector panel fixed on an outer wall of the left casing; a left LED light unit connected to the lamp switch fixed at an inner side of the reflector panel; a transparent cover respectively clamped on the left casing, the left base unit and the upper cover assembly outside the reflector panel.

4. A portable camping lamp according to claim 3 the upper cover assembly further comprising: an upper left cover unit and an upper right cover unit, the upper left cover unit and the upper right cover unit respectively fixed and mounted on upper portions of the left illumination unit and the right illumination unit; the upper left cover unit provided with a locking mechanism for locking the left illumination unit and the right illumination unit together; the locking mechanism locked on the locking hole; the locking mechanism mounted on the right casing, for clamping the auxiliary illumination assembly inside the accommodating slot.

5. A portable camping lamp according to claim 4 further comprising: a charging mechanism in the accommodating slot connected to the chargeable source unit; the chargeable source unit charging the auxiliary illumination assembly through the charging mechanism.

6. A portable camping lamp according to claim 5, the auxiliary illumination assembly further comprising: a main casing, a rechargeable battery and an auxiliary LED light unit mounted in the main casing; the auxiliary LED light unit electrically connected to the rechargeable battery; the main casing also provided with an auxiliary switch for turning the auxiliary LED light unit on and off; a conductive wire connected with the charging mechanism provided on the bottom of the main casing; the rechargeable battery electrically connected to the conductive wire; and the charging mechanism charging the rechargeable battery through the conductive wire.

7. A portable camping lamp according to claim 6, further including: a clamping hole matching the positioning hole formed on the side wall of the main casing; and one end of the positioning mechanism passes through the positioning hole and clamps on the clamping hole.

8. A portable camping lamp according to claim 7, further including the left base unit and the right base unit respectively having a left base and a right base; both of the outer walls of the left base and the right base provided with supporting blocks and grooves opposite to each other; whereby when the left illumination unit and the right illumination unit are opened, the supporting blocks on outer walls of the left base and the right base are correspondingly embedded into the grooves of the right base and the left base.

9. A portable camping lamp, comprising:

a left illumination unit having a left inner wall and a left base outer wall;

the left illumination unit having a left LED light unit with the illumination of the LEDs directed away from the left inner wall;

a right illumination unit having a right inner wall and a right base outer wall;

the right illumination unit having a right LED light unit with the illumination of the LEDs directed away from the right inner wall a hinge rotatably coupling the left illumination unit to the right illumination unit and having an axis in the left and right inner walls and the left and right base outer walls;

the hinge holding the left illumination unit and right illumination unit in a closed configuration when the left and right inner walls abut each other; and, the hinge holding the left illumination unit and right illumination unit in an open configuration when the left and right base outer walls abut each other.

10. A portable camping lamp according to claim 9, further including the left bottom outer wall substantially perpendicular to the left inner wall and the right bottom outer wall substantially perpendicular to the right inner wall.

11. A portable camping lamp according to claim 10, further including the outer walls of the left base and right base provided with supporting blocks and grooves opposite each other; when the left illumination unit and the right illumination unit are opened, the supporting blocks on the outer walls of the left base and the right base are correspondingly embedded into the grooves of the right base and left base.

12. A portable camping lamp according to claim 10, further including a hook attached to the camping lamp adjacent the axis of the hinge and the open hook end directed away from the left base and right base.

13. A portable illumination device having a closed position and an open position comprising:

a base assembly comprising a left base unit and a right base unit which are rotatably connected for rotation about an axis of rotation from a first position defining a closed position to a second position defining an open position;

mounted on the left base unit, a left illumination unit comprising an illumination source and a reflector wall and having a direction of illumination away from the reflector wall and:

mounted on the right base unit, a right illumination unit having an illumination source and a reflector wall and having a direction of illumination away from the reflector wall;

the axis of rotation being orthogonal to the direction of illumination of the left and right illumination assemblies;

whereby in the closed position the left illumination unit and the right illumination unit are adjacent with their respective reflectors and illumination sources in abutment and facing oppositely and upon rotation of the left and right base units into the open position the left and right illumination units rotate into an aligned position;

whereby in the closed position light from the right illumination unit and from the left illumination unit will extend in aligned opposite directions and when in the open position the light from each of said illumination units will extend in parallel.

* * * * *